US009605544B2

(12) United States Patent
Tibbott et al.

(10) Patent No.: US 9,605,544 B2
(45) Date of Patent: Mar. 28, 2017

(54) AEROFOIL

(71) Applicant: ROLLS-ROYCE PLC, London (GB)

(72) Inventors: Ian Tibbott, Lichfield (GB); Dougal Richard Jackson, Stanton-by-Bridge (GB)

(73) Assignee: ROLLS-ROYCE plc, London (GB)

( * ) Notice: Subject to any disclaimer, the term of this patent is extended or adjusted under 35 U.S.C. 154(b) by 380 days.

(21) Appl. No.: 14/333,033

(22) Filed: Jul. 16, 2014

(65) Prior Publication Data

US 2015/0044029 A1 Feb. 12, 2015

(30) Foreign Application Priority Data

Aug. 8, 2013 (GB) ..... 1314222.9

(51) Int. Cl.
*F01D 5/18* (2006.01)

(52) U.S. Cl.
CPC ..... *F01D 5/186* (2013.01); *F01D 5/18* (2013.01); *F01D 5/187* (2013.01);
(Continued)

(58) Field of Classification Search
CPC . F01D 5/18; F01D 5/187; F01D 5/188; F01D 5/189; F01D 5/186; F01D 25/12;
(Continued)

(56) References Cited

U.S. PATENT DOCUMENTS 5,562,409 A * 10/1996 Livsey ..... F01D 5/187 415/115
5,667,359 A * 9/1997 Huber ..... F01D 5/186 416/96 A (Continued)

FOREIGN PATENT DOCUMENTS

EP 1 001 135 A2 5/2000
EP 1 584 790 A2 10/2005

(Continued)

OTHER PUBLICATIONS

Oct. 8, 2014 Search Report issued in European Application No. 14177271.

(Continued)

*Primary Examiner* — John K Fristoe, Jr.
*Assistant Examiner* — Sang K Kim
(74) *Attorney, Agent, or Firm* — Oliff PLC

(57) ABSTRACT

An aerofoil component of a gas turbine engine has an aerofoil portion which spans, in use, a working gas annulus of the engine. The aerofoil portion has a pressure side outer wall and a suction side outer wall, each extending from the leading edge to the trailing edge of the aerofoil portion. The aerofoil portion further has one or more main passages which extend in the annulus-spanning direction of the aerofoil portion and which receive, in use, a flow of coolant. The aerofoil portion further has one or more suction wall passages which extend in the annulus-spanning direction of the aerofoil portion and which receive, in use, a flow of coolant, each suction wall passage being bounded on opposing first sides by the suction side outer wall and an inner wall of the aerofoil portion, the inner wall separating the suction wall passages from the main passages.

11 Claims, 8 Drawing Sheets

(52) U.S. Cl.
CPC .. *F05D 2260/201* (2013.01); *F05D 2260/202* (2013.01); *F05D 2260/22141* (2013.01)

(58) Field of Classification Search
CPC ..... F05D 2260/201; F05D 2260/204; F05D 2260/221; F05D 2260/2212; F05D 2260/22141
See application file for complete search history.

(56) References Cited

U.S. PATENT DOCUMENTS

| | | | | |
|---|---|---|---|---|
| 7,377,746 | B2 * | 5/2008 | Brassfield | B22C 9/043 29/888.024 |
| 7,568,887 | B1 * | 8/2009 | Liang | F01D 5/187 416/97 R |
| 8,535,004 | B2 * | 9/2013 | Campbell | F01D 5/148 415/115 |
| 9,267,381 | B2 * | 2/2016 | Morris | F01D 5/183 |
| 2011/0236221 | A1 | 9/2011 | Campbell | |
| 2015/0110611 | A1 * | 4/2015 | Bergholz | F01D 5/187 415/178 |

FOREIGN PATENT DOCUMENTS

| | | | |
|---|---|---|---|
| EP | 1 790 819 | A1 | 5/2007 |
| WO | WO 2012/036850 | A1 | 3/2012 |
| WO | 2013/181132 | A1 | 12/2013 |

OTHER PUBLICATIONS

Mar. 12, 2014 Search Report issued in British Application No. GB 1314222.9.

* cited by examiner

AEROFOIL

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION (1) Field of the Invention

The present invention relates to an aerofoil component of a gas turbine engine, and particularly an aerofoil portion which contains one or more passages for the transport of coolant therethrough.

(2) Description of Related Art Including Information Disclosed Under 37 CFR 1.97 and 1.98

The performance of the simple gas turbine engine cycle, whether measured in terms of efficiency or specific output is improved by increasing the turbine gas temperature. It is therefore desirable to operate the turbine at the highest possible temperature. For any engine cycle compression ratio or bypass ratio, increasing the turbine entry gas temperature will always produce more specific thrust (e.g. engine thrust per unit of air mass flow). However as turbine entry temperatures increase, the life of an un-cooled turbine falls, necessitating the development of better materials and the introduction of cooling mechanisms.

In modern engines, the high pressure (HP) turbine gas temperatures are now much hotter than the melting point of the blade materials used and in some engine designs the intermediate pressure (IP) and low pressure (LP) turbines are also cooled. During its passage through the turbine the mean temperature of the gas stream decreases as power is extracted. Therefore the need to cool the static and rotary parts of the engine structure decreases as the gas moves from the HP stage(s) through the IP and LP stages towards the exit nozzle.

Internal convection and external films are the prime methods of cooling the gas-path aerofoils, for example aerofoils, platforms, shrouds, shroud segments and turbine nozzle guide vanes (NGVs). Air is conventionally used as a coolant and is flowed in and around the gas-path aerofoils.

FIG. 1 shows an isometric view of a typical cooled stage of a gas turbine engine. Cooling air flows are indicated by arrows. FIG. 1 shows HP turbine NGVs 1 and HP rotor blades 2. Both the NGVs 1 and HP rotor blades 2 have aerofoil portions 100 which span the working gas annulus of the engine.

HP turbine NGVs generally consume the greatest amount of cooling air flow in high temperature engines. HP rotor blades typically use about half of the NGV cooling air flow. The IP and LP stages downstream of the HP turbine use progressively less cooling air flow.

The HP rotor blades 2 are cooled by using high pressure air from the compressor that has by-passed the combustor and is therefore relatively cool compared to the gas temperature. Typical cooling air temperatures are between 800 and 1000 K, while gas temperatures can be in excess of 2100 K.

The cooling air from the compressor that is used to cool the hot turbine components is not used fully to extract work from the turbine. Extracting coolant flow therefore has an adverse effect on the engine operating efficiency. It is thus important to use this cooling air as effectively as possible.

The ever increasing gas temperature levels combined with a drive towards higher Overall Pressure Ratios (OPR) and flatter combustion radial profiles, in the interests of reduced combustor emissions, have resulted in an increase in local gas temperatures and external heat transfer coefficients experienced by the HP turbine NGVs and rotor blades. This puts considerable demands on the internal and external cooling schemes that are heavily relied on to ensure aerofoil durability.

The last 10 years has seen a significant rise in the inlet gas temperature and overall engine pressure ratio on new engine designs, and this has brought a new raft of problems. However, the performance of the engine, and in particular the turbine, is still greatly affected by (a) the quantity of coolant consumed by the hot end aerofoils, and (b) the way the cooling flow is re-introduced into the gas-path. Therefore, while aerofoils must be provided with sufficient coolant flow to ensure adequate mission lives, it is imperative that the cooling scheme designs do not waste flow.

FIG. 2 shows a transverse cross-section through an HP turbine rotor blade aerofoil portion 100 with wall cooling around the suction surface S.

Suction side outer wall 110 and pressure side outer wall 140 define the external pressure side P and suction side S aerofoil surfaces of the aerofoil portion 100. Each outer wall 110, 140 extends from a leading edge LE to a trailing edge TE of the aerofoil portion 100. The aerofoil portion 100 in FIG. 2 has four main coolant passages 114 that extend in the annulus-spanning direction of the aerofoil portion 100. The front three of these passages are interconnected such that cooling air flows through the passages in series, reversing direction, as indicated by curved block arrows, between passages. The cooling air enters the main passages from feed passages at the root of blade, as indicated by the straight block arrows.

The aerofoil portion 100 further has a plurality of suction wall passages 106 that also extend in the annulus-spanning direction of the aerofoil portion 100. The suction wall passages 106 are bounded on opposing first sides by the suction side outer wall 110 and an inner wall 108 that separates the suction wall passages 106 from the main passages 114. Each suction wall passage 106 is bounded on opposing second sides by a pair of dividing walls 102 which extend between the suction side outer wall 110 and the inner wall 108. In each passage 106, one of the pair of dividing walls 102 is closer to the leading edge LE of the aerofoil portion 100 and the other of the pair of dividing walls 102 is closer to the trailing edge TE. Fillets 104 smooth the transitions from the dividing walls 102 to the inner wall 108 and to the suction side outer wall 110. As indicated by curved block arrows, coolant can flow in series through the suction wall passages with direction reversal.

However, this arrangement can cause thermo-mechanical structural problems and stress. A main cause of the stress results from differential thermal effects between the hot suction side outer wall 110 and the relatively cool inner wall 108, the highest thermal gradients occurring in the dividing walls 102 and fillets 104. For example, thermal growth of the hot suction side outer wall 110 is much greater than the cold inner wall 108 during transient throttle push, placing the outer wall 110 into compression and the inner wall 108 into tension. As a result, major stress concentrations are produced, particularly in the fillets 104. The thermal gradients at the dividing walls 102 further increase the overall stress levels. In particular, the fillet radii of the fillets 104 closest to the suction surface S are initially in compression during take off conditions when the suction side outer wall 110 reaches its maximum temperature. The local stress level in these fillets 104 can cause the material of the blade to plastically deform or creep such that when the suction side outer wall 110 cools down the fillets 104 can develop micro cracks in tension. When the process is repeated, cracks may propagate in the walls 102, 108, 110 due to low cycle thermal fatigue of the material.

BRIEF SUMMARY OF THE INVENTION

The present invention seeks to provide an improved aerofoil component.

A first aspect of the invention provides an aerofoil component of a gas turbine engine, the component having an aerofoil portion which spans, in use, a working gas annulus of the engine, the aerofoil portion having:

- a pressure side outer wall and a suction side outer wall which respectively define the external pressure side and suction side aerofoil surfaces of the aerofoil portion, each outer wall extending from the leading edge to the trailing edge of the aerofoil portion;
- one or more main passages which extend in the annulus-spanning direction of the aerofoil portion and which receive, in use, a flow of coolant therethrough;
- one or more suction wall passages which extend in the annulus-spanning direction of the aerofoil portion and which receive, in use, a flow of coolant therethrough, each suction wall passage being bounded on opposing first sides by the suction side outer wall and an inner wall of the aerofoil portion, the inner wall separating the suction wall passages from the main passages; and
- a plurality of dividing walls which extend between the suction side outer wall and the inner wall, each suction wall passage being bounded on opposing second sides by a pair of the dividing walls, one of the pair of the dividing walls being closer to the leading edge and the other of the pair of the dividing walls being closer to the trailing edge;
- wherein the dividing walls have fillets to smooth the transitions from the dividing walls to the inner wall and the suction side outer wall, the fillets being shaped, such that on transverse cross-sections to the annulus-spanning direction of the aerofoil portion, (i) said opposing second sides of the suction wall passages are substantially semi-circular, and/or (ii) the radii of curvature of the fillets are equal, within ±25%, to the thickness of the suction side outer wall wherein the inner wall curves into the suction wall passages to give each suction wall passage a kidney-bowl shape on the transverse cross-sections.

Advantageously, the substantially semi-circular opposing sides of each suction wall passage and/or the radii of curvature of the fillets can reduce stress concentrations in the fillets and promote the creation of dual vortices of coolant in the suction wall passage for more effective removal of heat from the suction side outer wall.

A second aspect of the invention provides a gas turbine engine having one or more aerofoil components according to the first aspect.

Optional features of the invention will now be set out. These are applicable singly or in any combination with any aspect of the invention.

A kidney-bowl shape on the transverse cross-sections can be particularly effective for creating the dual vortices. Also, by curving the inner wall into the suction wall passages, the overall length of the inner wall on the transverse cross-sections can be increased. This can enhance the compliance of the inner wall, reducing its constraining effect on the outer wall such that differential thermal effects do not generate such high stress concentrations in the fillets. For example, the inner wall may curve into each suction wall passage such that, on the transverse cross-sections, the inner wall forms a protrusion into the suction wall passage, the protrusion turning through at least 90° of arc.

The inner wall may be thinner than the suction side outer wall. This also helps to increase the compliance of the inner wall. For example, the ratio of the thickness of the suction side outer wall to the inner wall may be in the range from 1.4 to 1.6.

On the transverse cross-sections and in respect of each suction wall passage, the inner wall may reduce in thickness from locations adjacent the fillets of the respective dividing walls to a central region of the inner wall.

The minimum thicknesses of the dividing walls may be equal, within ±25%, to twice the thickness of the suction side outer wall. This can strengthen the dividing walls, and can also have an effect of increasing heat conduction along the dividing walls and into the inner wall, and hence can reduce differential thermal effects between the suction side outer wall and the inner wall.

The suction side outer wall may have a plurality of effusion holes for passing coolant from the suction wall passages to the suction side aerofoil surface.

Each suction wall passage may have heat transfer augmentation formations provided by the suction side outer wall and/or the inner wall, the heat transfer augmentation formations causing the coolant flow to separate from and reattach to the respective wall. For example, the heat transfer augmentation formations may be trip-strips and/or steps. Rows of trip-strips and/or steps which are oppositely angled (e.g. so that a trip-strip or step from one row and an adjacent trip-strip or step from a different row together form a chevron shape) can be particularly effective.

The suction wall passages may further have a plurality of pedestals extending across the passage to connect the inner wall to the suction side outer wall. The pedestals can promote heat conduction between the suction side outer wall and the inner wall, and promote turbulent mixing of the coolant in the passage.

The inner wall may further have a plurality of through-holes for producing impingement jets impinging on the suction side outer wall, the impingement jets being formed from coolant passing through the through-holes from the main passages into the suction wall passages.

The aerofoil portion may further have connecting walls which bound the main passages and extend from the pressure side outer wall to the inner wall, the connecting walls meeting the inner wall only at locations which are directly opposite to where the dividing walls meet the inner wall. In this way, the connecting walls can be prevented from compromising the flexibility of the inner wall.

The aerofoil component may be a turbine section rotor blade, e.g. a high pressure turbine rotor blade.

BRIEF DESCRIPTION OF THE SEVERAL VIEWS OF THE DRAWINGS

Embodiments of the invention will now be described by way of example with reference to the accompanying drawings in which.

DETAILED DESCRIPTION OF THE INVENTION

Figure 3:
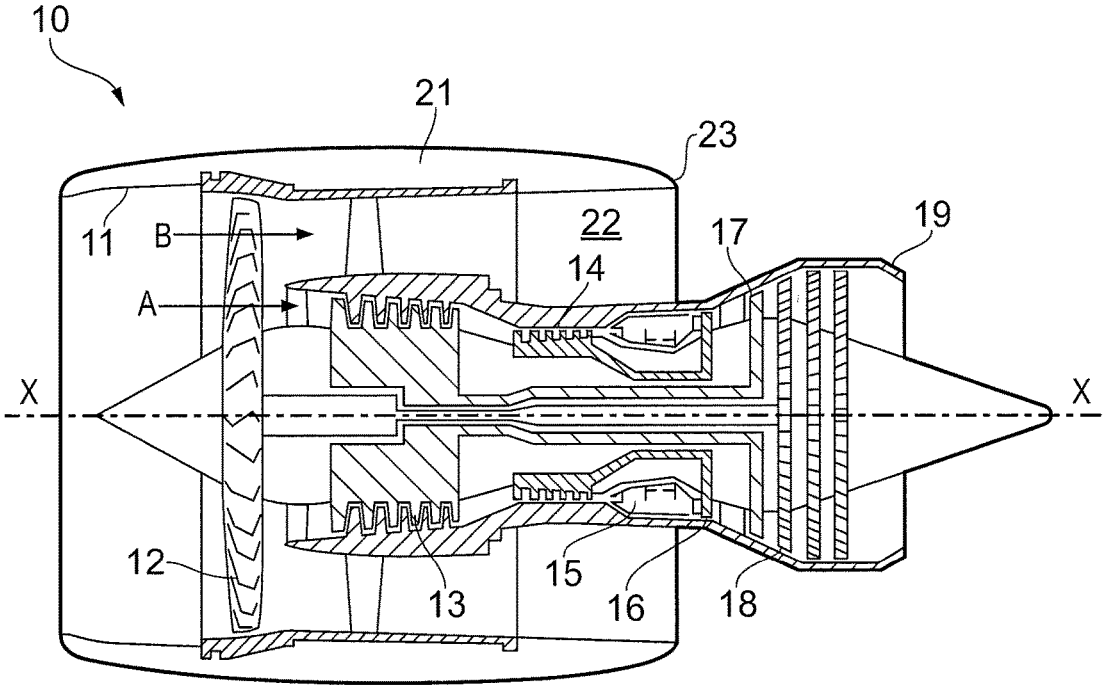
FIG. 3 shows a longitudinal sectional view of a ducted fan gas turbine engine.

With reference to FIG. 3, a ducted fan gas turbine engine suitable for incorporating the present invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, an HP turbine 16, an IP turbine 17, a LP turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the IP compressor 13 and a second air flow B which passes through the bypass duct 22 to provide propulsive thrust. The IP compressor 13 compresses the air flow A directed into it before delivering that air to the HP compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The HP, IP and LP turbines respectively drive the HP and IP compressors 14, 13 and the fan 12 by suitable interconnecting shafts.

The HP turbine aerofoil portions are cooled by using high pressure air from the compressor that has by-passed the combustor and is therefore relatively cool compared to the gas temperature. Typical cooling air temperatures are between 800 and 1000 K, while gas temperatures can be in excess of 2100 K.

Figure 4:
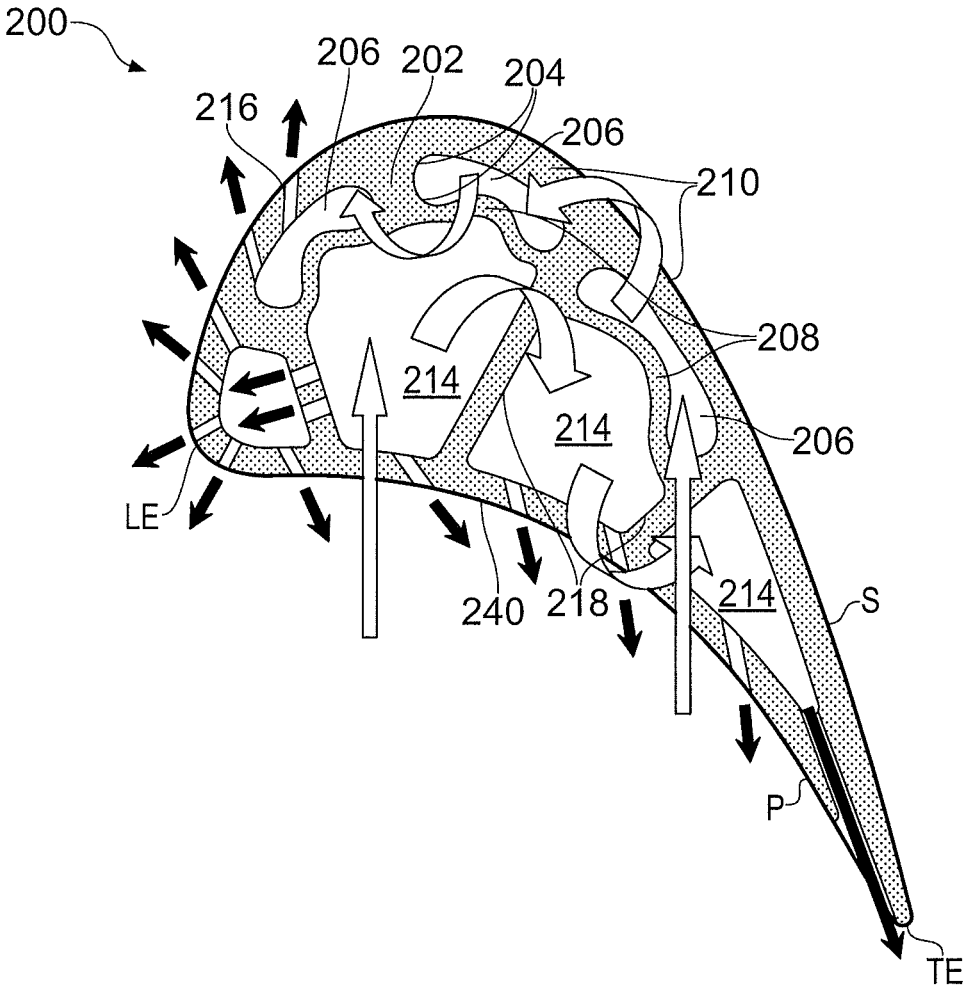
FIG. 4 shows a transverse cross-section of an HP turbine rotor blade aerofoil of the present invention with wall cooling suction wall passages around the suction surface.

FIG. 4 shows a transverse cross-sectional view through aerofoil portion 200 of a rotor blade of the HP turbine 16. The aerofoil portion 200 has some similarities to the aerofoil portion of FIG. 2.

Thus suction side outer wall 210 and pressure side outer wall 240 define the external pressure side P and suction side S aerofoil surfaces of the aerofoil portion 200. Each outer wall 210, 240 extends from a leading edge LE to a trailing edge TE of the aerofoil portion 200. The aerofoil portion 200 has three main coolant passages 214 that extend in the annulus-spanning direction of the aerofoil portion 200. These passages are interconnected such that cooling air flows through the passages in series, reversing direction, as indicated by curved block arrows, between passages. The cooling air enters the main passages from one or more feed passages at the root of blade, as indicated by the straight block arrows.

Further, the aerofoil portion 200 also has a plurality of suction wall passages 206 that extend in the annulus-spanning direction of the aerofoil portion 200. The suction wall passages 206 are bounded on opposing first sides by the suction side outer wall 210 and an inner wall 208 that separates the suction wall passages 206 from the main passage 214. Cooling air can enter the suction wall passages from the feed passages at the root of blade. As indicated by curved block arrows, the coolant can flow through the suction wall passages in series with direction reversal. Each suction wall passage 206 is bounded on opposing second sides by a pair of dividing walls 202 which extend between the suction side outer wall 210 and the inner wall 208. In each passage 206, one of the pair of dividing walls 202 is closer to the leading edge LE of the aerofoil portion 200 and the other of the pair of the dividing walls 202 is closer to the trailing edge TE. Fillets 204 smooth the transitions from the dividing walls 202 to the inner wall 208 and to the suction side outer wall 210.

The outer walls 210, 240 contain a plurality of effusion holes 216 for the flow of coolant from the interior to the exterior of the aerofoil portion 200. For example the effusion holes 216 in the suction side outer wall 210 allow coolant from the suction wall passages 206 to flow over the suction side aerofoil surface S.

Figure 5:
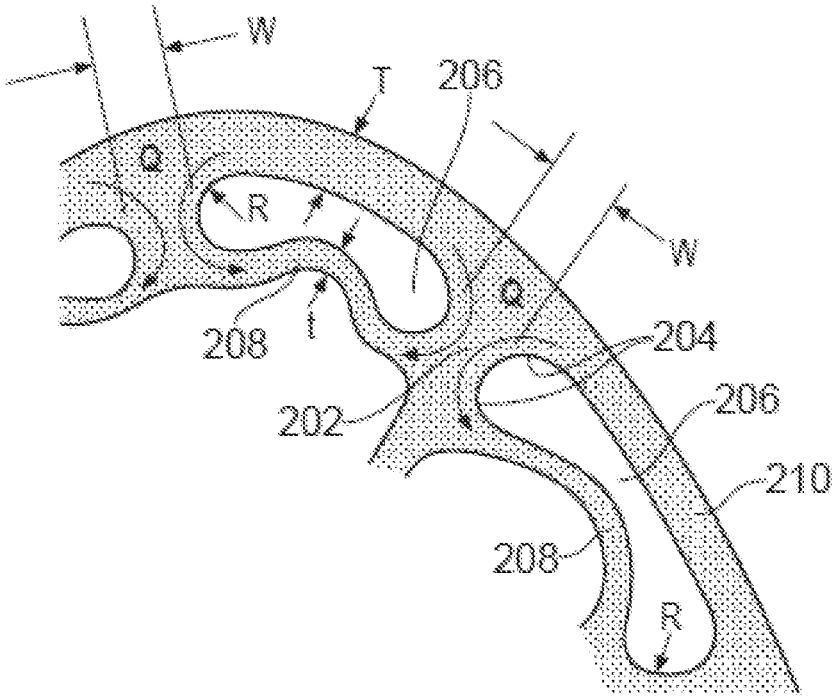
FIG. 5 shows a close-up view of two of the suction wall passages of the cross-section of FIG. 4.
Figure 6:
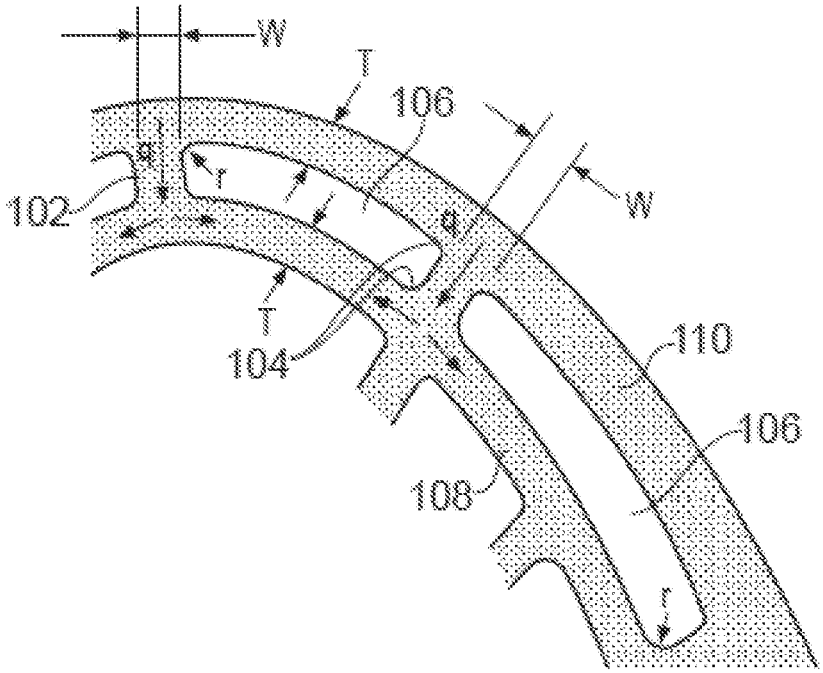
FIG. 6 PRIOR ART
FIG. 6 shows a close-up view of two of the suction wall passages of the cross-section of FIG. 2.

In order to improve resistance to low cycle thermal fatigue, the fillets 204 are shaped such that on transverse cross-sections to the annulus-spanning direction of the aerofoil 200, the opposing second sides of the suction wall passages 206 can be substantially semi-circular. This is illustrated in FIG. 5 which shows a close-up view of two of the suction wall passages 206 of the cross-section of FIG. 4. The fillets 204 have radii of curvature R which are large enough to ensure that the two fillets provided by each dividing wall 202 in a given passage 206 merge together to produce a continuously curved surface. For comparison, FIG. 6 shows a close-up view of two of the suction wall passages 106 of the cross-section of FIG. 2. In this case, the two fillets 104 provided by each dividing wall 102 in a given passage 106 have smaller radii of curvature r, such that the fillets do not merge together and the dividing wall 102 has a flat surface between the fillets. The increased radius of curvature R reduces stress concentrations in the fillets 204, thereby decreasing the amount of plastic deformation or creep that occurs in the fillets when the aerofoil portion 200 is exposed to high thermal gradients. For example, the radius of curvature R of the fillets 204 may be equal to the thickness of the suction side outer wall 210, to within ±25%.

The substantially semi-circular shape of the opposing second sides of the suction wall passages 206 can also provide benefits in terms of the flow of coolant in the passages. In particular, dual vortices (discussed in more detail below) can be set up in each suction wall passage 206, e.g. such that the semi-circular shapes of opposing sides of each passage 206 contain respective and oppositely-rotating vortices.

The aerofoil portion 200 can have further adaptations to improve its thermo-mechanical performance.

For example, unlike the aerofoil portion 100 (shown in FIGS. 2 and 6), the inner wall 208 of the aerofoil portion 200 curves into the suction wall passages 206 to give each suction wall passage 206 a kidney-bowl shape on the transverse cross-section, as shown in FIGS. 4 and 5. This kidney-bowl shape also helps to promote the creation of dual vortices.

The curvature of the inner wall 208 which produces the kidney-bowl shapes of the suction wall passages 206 also results in the length of the inner wall 208 on the transverse cross-section being increased relative to the length of the suction side outer wall 210. This length increase in turn increases the compliance or flexibility of the inner wall 208 such that it imposes a reduced constraint on the outer wall 210. In this way, the compressive stress experienced by the outer wall 210 when it undergoes thermal growth can be reduced, and stress concentrations in the fillets 204 can be decreased. For example, as shown in FIG. 5, the inner wall may curve into each suction wall passage such that, on the transverse cross-section, a protrusion into the passage is formed which turns through at least 90° of arc.

In the aerofoil portion 100, the thicknesses T of the inner wall 108 and of the outer wall 110 are approximately the same (as shown in FIG. 6). However, a further adaptation of the aerofoil portion 200 is to reduce the thickness t of the inner wall 208 relative to the thickness T of the outer wall 210 (as shown in FIG. 5). This also has the effect of increasing the compliance of the inner wall 208 to better accommodate thermal expansion of the outer wall 210.

For example, the inner wall 108 and the outer wall 110 are generally formed of the same superalloy (e.g. CMSX-4 single crystal alloy). At typical operating temperatures of the inner wall 108 and of the outer wall 110 (800° C. and 1950° C. respectively), such a superalloy can be about 50% stronger at the inner wall than at the outer wall (1% yield proof stresses may be about 960 MPa and 640 MPa respectively). A suitable ratio of T/t may thus be in the range from about 1.4 to 1.6 to compensate for the strength difference.

Another adaptation (not shown in FIG. 5) that can increase the compliance of the inner wall 208 is to progressively thin the wall from locations adjacent the fillets 204 to a region at the centre of the wall. Advantageously, the wall can thus be thinned at a region distal from the fillets 204, and thus removed from stress concentrations at the fillets.

As shown in FIG. 4, connecting walls 218 bound the main passages 214 and link the pressure side outer wall 240 and the inner wall 208. To preserve the flexibility of the inner wall 208, the connecting walls 218 may only meet the inner wall 208 at locations directly opposite to where the dividing walls 206 meet the inner wall 208 (i.e. rather than at locations between the dividing walls 206).

Comparing FIGS. 5 and 6, the thickness W of the dividing walls 202 of the aerofoil portion 200 can be increased relative to the thickness w of the dividing walls 102 of the aerofoil portion 100. This can strengthen the dividing walls 202, and can also have an effect of increasing heat conduction (Q in FIG. 5 and q in FIG. 6, and also indicated by white arrows in FIGS. 5 and 6) along the dividing walls and into the inner wall, and hence can reduce differential thermal effects between the outer wall 210 and the inner wall 208. For example, the minimum thickness W of the dividing walls 202 may be equal, to within ±25%, to twice the thickness of the suction side outer wall 210.

Figure 7:
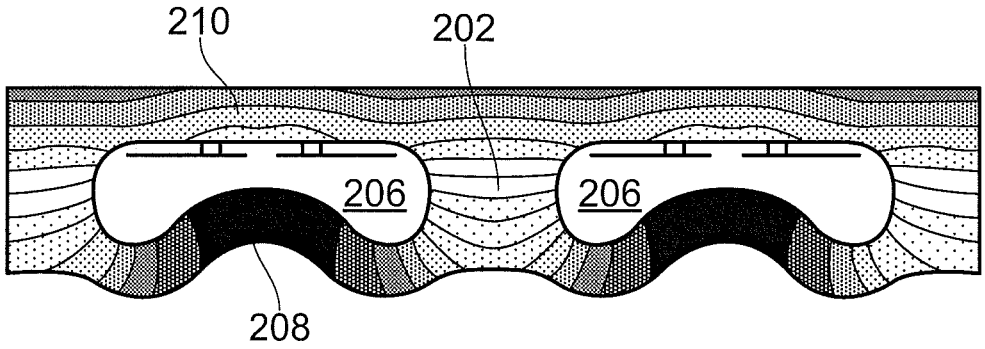
FIG. 7 shows modelled thermal gradients in the walls around the suction wall passages.
Figure 8:
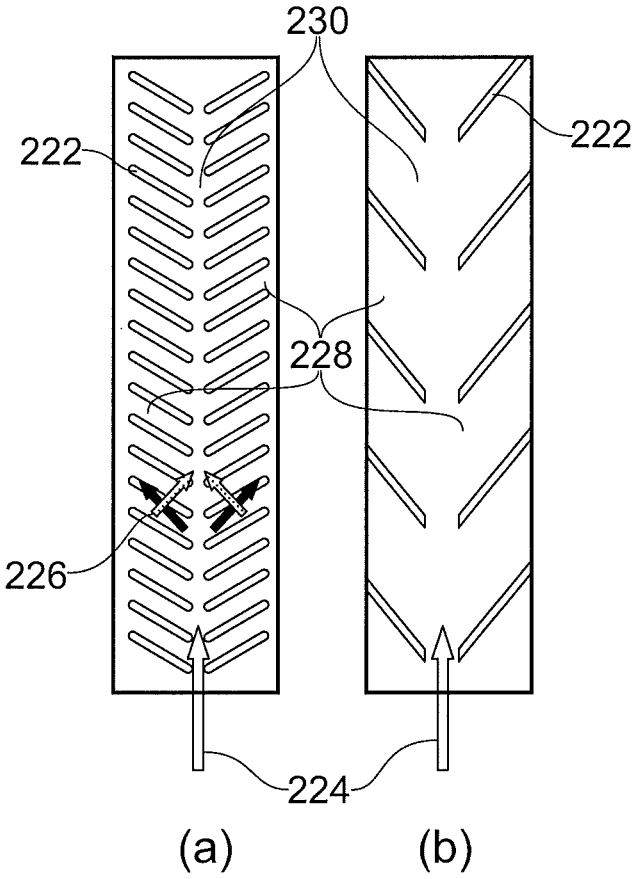
FIG. 8 shows plan views of a wall surface inside a suction wall passage with different configurations (a) and (b) of trip-strip heat transfer augmentation formations.

FIG. 7 shows modelled thermal gradients present in the suction side outer wall 210, inner wall 208 and dividing walls 202 around the suction wall passages 206. These gradients can be reduced by the provision of trip-strip and/or step heat transfer augmentation formations 222, e.g. on the suction side outer wall 210, as illustrated in FIG. 8 which shows plan views of the surface of the outer wall 210 inside a suction wall passage 206 with different configurations (a) and (b) of trip-strip heat transfer augmentation formations. In FIG. 8(*a*), half the trip-strip heat augmentation features are provided by the suction side outer wall 210 and half by the inner wall 208, the trip-strips of the two walls being staggered relative to each other, whereas in FIG. 8(*b*), the trip-strip heat augmentation features are provided by the suction side outer wall 210 only. However, on a given wall the pitch to height ratios of the trip-strip heat augmentation features in both configurations are approximately the same. Primary coolant flow 224 and secondary coolant flow 226 are indicated by arrows. Regions with a high local heat transfer coefficient 230 and a low local heat transfer coefficient 228 are also indicated.

Figure 9:
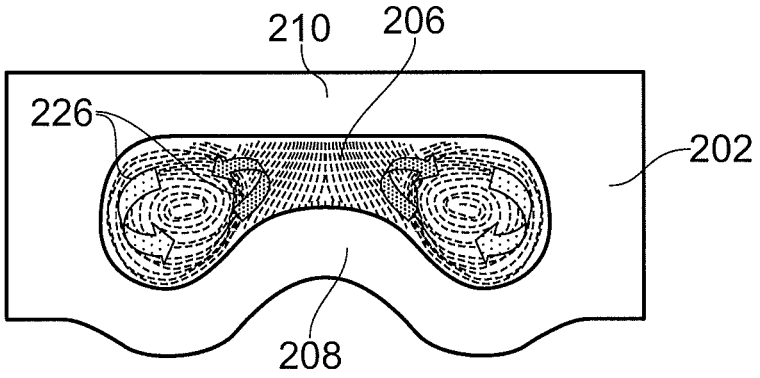
FIG. 9 shows modelled secondary flows inside a suction wall passage.

The trip-strips 222 are in two oppositely angled rows so that adjacent trip-strips from different rows make a chevron shape, the rows extending along the length of the passage. The secondary flows 226 encouraged by these trip-strips promote the formation of the dual vortices discussed above, as illustrated by FIG. 9 which shows CFD modelled secondary flows inside a suction wall passage 206 having a chevron arrangement of trip-strips 222. Higher levels of heat transfer are developed at the centre of the two rows of trip-strips where the vortex flows converge on the outer wall 210. Conversely lower levels of heat transfer are developed at the outer sides of the two rows, for example near the fillet radii 204. Reversing the chevron geometry can produce the opposite effect.

Figure 1:
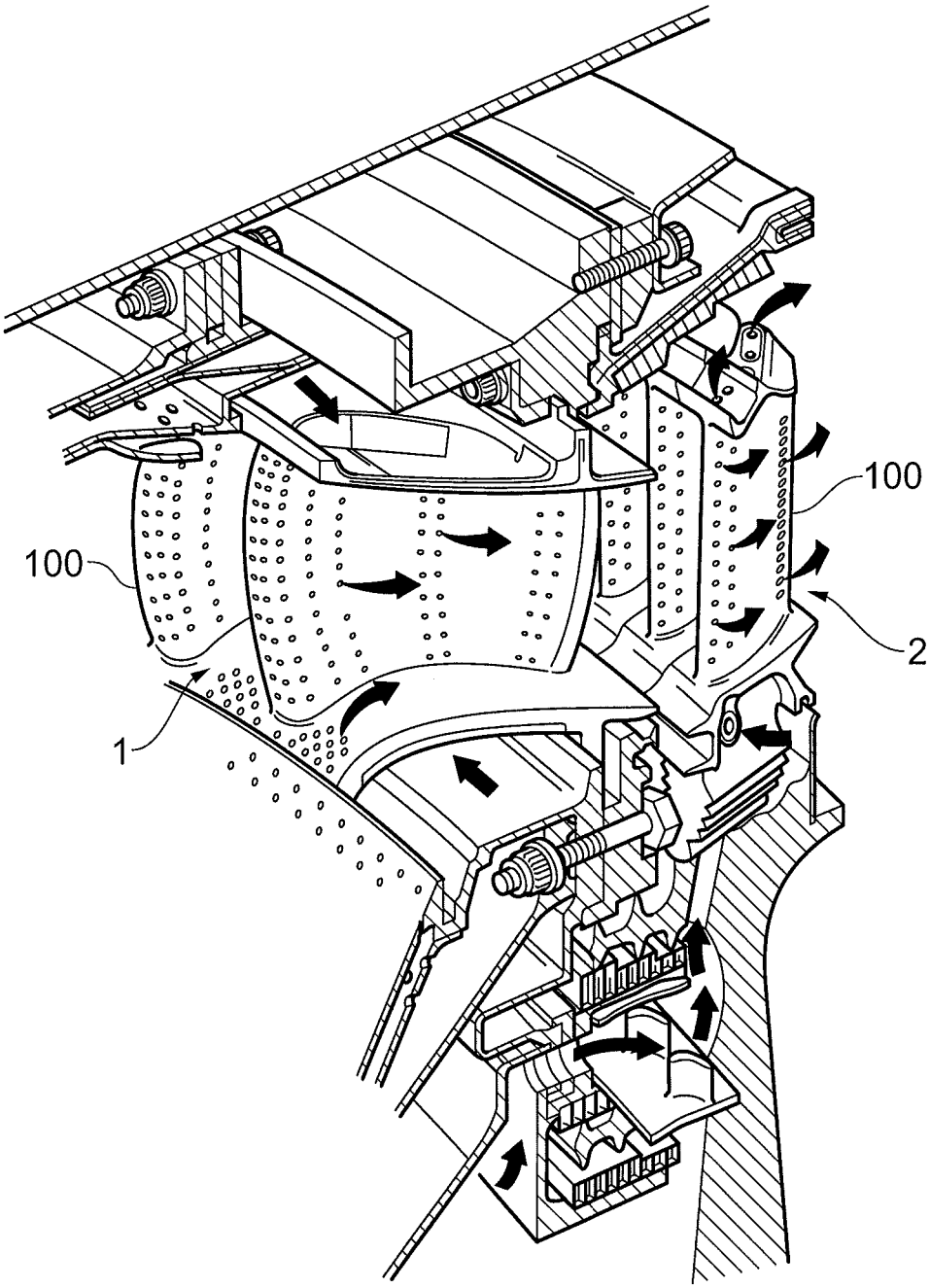
FIG. 1 shows an isometric view of a typical single stage cooled turbine.
Figure 2:
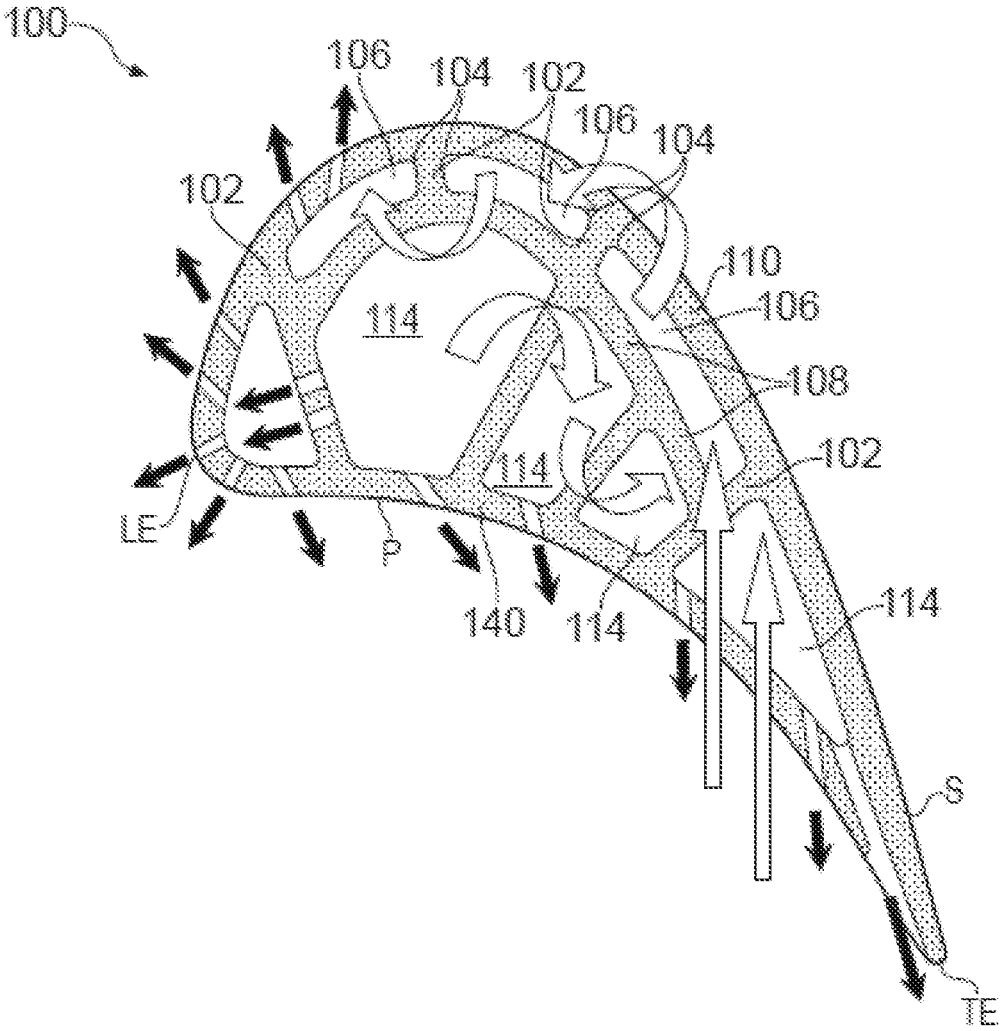
FIG. 2 PRIOR ART
FIG. 2 shows a transverse cross-section an HP turbine rotor blade aerofoil portion with suction wall passages for flow of a coolant.

The kidney-bowl shape of the suction wall passage 206 in combination with the chevron arrangement of the trip strips 222 increases the overall level of heat transfer from the outer wall 210 relative to that from the outer wall 110 of the aerofoil portion 100 shown in FIGS. 2 and 6. This is because the dual vortices increase the suction wall passage 206 flow Reynolds number and corresponding Nusselt number. Additionally, the dual vortices direct the coolant from the cool surface of the inner wall 208 towards the suction side outer wall 210.

Figure 10:
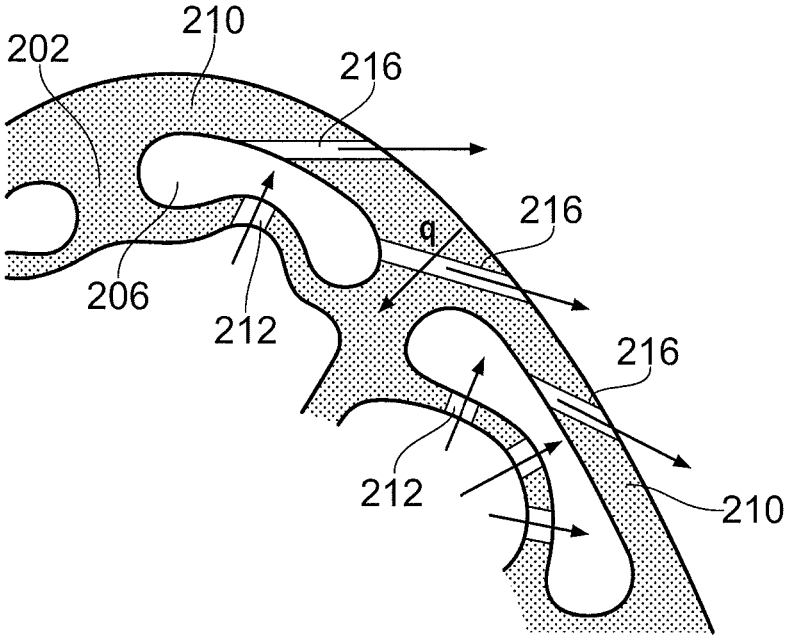
FIG. 10 shows a cross-sectional view of two suction wall passages in a variant of the HP turbine rotor blade aerofoil of FIG. 4.

The aerofoil portion 200 may have further cooling arrangements. For example, FIG. 10 shows a cross-sectional view of two suction wall passages 206 in a variant of the HP turbine rotor blade aerofoil of FIG. 4. Impingement jets formed by through-holes 212 in the inner wall 208 impinge coolant on the outer wall 210 as they feed coolant from the main passages 214 into the suction wall passages 206. The jets help to increase heat transfer between the suction side outer wall 210 and the coolant.

FIG. 10 also shows in more detail the effusion holes 216 for the flow of coolant from the suction wall passages 206 to the exterior of the aerofoil portion 200. Advantageously the semi-circular sides of the suction wall passages 206 reduce the risk of back-strike on the inner wall 208 when e.g. a laser or electrical discharge machining (EDM) electrode drills the effusion holes 216. Such back-strike can result in blades being scrapped. In relation to laser drilling, the increased distance between the two walls 208, 210 at the semi-circular sides improves access for the insertion of a material to absorb or fragment the laser beam, and in relation to EDM, the increased distance allows more time to stop travel of the EDM tool after it breaks through the outer wall 210.

Figure 11:
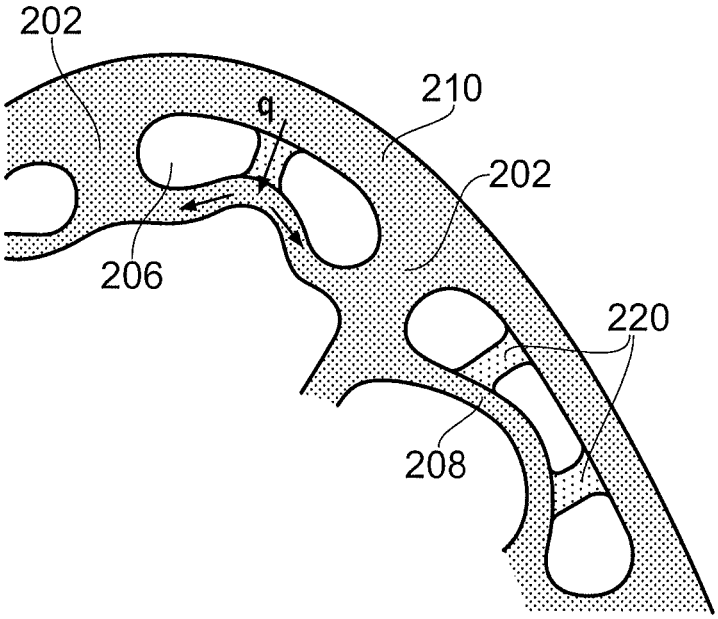
FIG. 11 shows a cross-sectional view of two suction wall passages in a further variant of the HP turbine rotor blade aerofoil of FIG. 4.

FIG. 11 shows a cross-sectional view of two suction wall passages 206 in a further variant of the HP turbine rotor blade aerofoil of FIG. 4. Pedestals 220 extend across the passages 206 to connect the inner wall 208 to the suction side outer wall 210. The pedestals 220 provide a further conduction path between the hot outer wall 210 and the relatively cool inner wall 208 for the flow of heat q, helping to reduce thermal gradients and better matching the thermal growths of the walls 210, 208. The pedestals 220 may also promote turbulent mixing of the coolant in the passages 206. However, they can reduce the flexibility of the inner wall 208.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

SEQUENCE LISTING

Not applicable

The invention claimed is:

1. An aerofoil component of a gas turbine engine, the component having an aerofoil portion which spans, in use, a working gas annulus of the engine, the aerofoil portion comprising:

a pressure side outer wall and a suction side outer wall which respectively define the external pressure side and suction side aerofoil surfaces of the aerofoil portion, each outer wall extending from the leading edge to the trailing edge of the aerofoil portion;

one or more main passages which extend in the annulus-spanning direction of the aerofoil portion and which receive, in use, a first flow of coolant therethrough;

one or more suction wall passages which extend in the annulus-spanning direction of the aerofoil portion and which receive, in use, a second flow of coolant therethrough, each suction wall passage being bounded on opposing first sides by the suction side outer wall and an inner wall of the aerofoil portion, the inner wall separating the suction wall passages from the main passages; and a plurality of dividing walls which extend between the suction side outer wall and the inner wall, each suction wall passage being bounded on opposing second sides by a pair of the dividing walls, one of the pair of the dividing walls being closer to the leading edge and the other of the pair of the dividing walls being closer to the trailing edge, wherein the dividing walls have fillets to smooth the transitions from the dividing walls to the inner wall and the suction side outer wall, the fillets being shaped, such that on transverse cross-sections to the annulus-spanning direction of the aerofoil portion, the radii of curvature of the fillets are equal, within ±25%, to the thickness of the suction side outer wall, and wherein the length of the surface of the inner wall forming a boundary between the inner wall and the suction wall passage, on the transverse cross-section is increased relative to the length of the surface of the suction side outer wall forming a boundary between the suction side outer wall and the suction wall passage, and the inner wall curves into the suction wall passages to give each suction wall passage a kidney-bowl shape on the transverse cross-sections.

2. The aerofoil component according to claim 1, wherein said opposing second sides of the suction wall passages are substantially semi-circular.

3. The aerofoil component of claim 2, wherein the inner wall curves into each suction wall passage such that, on the transverse cross-sections, the inner wall forms a protrusion into the suction wall passage, the protrusion turning through at least 90° of arc.

4. The aerofoil component of claim 1, wherein the inner wall is thinner than the suction side outer wall.

5. The aerofoil component of claim 1, wherein, on the transverse cross-sections and in respect of each suction wall passage, the inner wall decreases in thickness from locations adjacent the fillets of the respective dividing walls to a central region of the inner wall.

6. The aerofoil component of claim 1, wherein the minimum thicknesses of the dividing walls are equal to twice the thickness of the suction side outer wall, within ±25%.

7. The aerofoil component of claim 1, wherein the suction side outer wall has a plurality of effusion holes for passing coolant from the suction wall passages to the suction side aerofoil surface.

8. The aerofoil component of claim 1, wherein each suction wall passage has heat transfer augmentation formations provided by the suction side outer wall and/or the inner wall, the heat transfer augmentation features causing the coolant flow to separate from and reattach to the suction side outer wall and/or the inner wall on which the transfer augmentation formations are provided.

9. The aerofoil component of claim 1, wherein the inner wall has a plurality of through-holes for producing impingement jets impinging on the suction side outer wall, the impingement jets being formed from coolant passing through the through-holes from the main passages into the suction wall passages.

10. The aerofoil component of claim 1, wherein each suction wall passage further has a plurality of pedestals extending across the passage to connect the inner wall to the suction side outer wall.

11. A gas turbine engine having an aerofoil component of a gas turbine engine, the component having an aerofoil portion which spans, in use, a working gas annulus of the engine, the aerofoil portion comprising:

a pressure side outer wall and a suction side outer wall which respectively define the external pressure side and suction side aerofoil surfaces of the aerofoil portion, each outer wall extending from the leading edge to the trailing edge of the aerofoil portion;

one or more main passages which extend in the annulus-spanning direction of the aerofoil portion and which receive, in use, a first flow of coolant therethrough;

one or more suction wall passages which extend in the annulus-spanning direction of the aerofoil portion and which receive, in use, a second flow of coolant therethrough, each suction wall passage being bounded on opposing first sides by the suction side outer wall and an inner wall of the aerofoil portion, the inner wall separating the suction wall passages from the main passages; and a plurality of dividing walls which extend between the suction side outer wall and the inner wall, each suction wall passage being bounded on opposing second sides by a pair of the dividing walls, one of the pair of the dividing walls being closer to the leading edge and the other of the pair of the dividing walls being closer to the trailing edge, wherein the dividing walls have fillets to smooth the transitions from the dividing walls to the inner wall and the suction side outer wall, the fillets being shaped, such that on transverse cross-sections to the annulus-spanning direction of the aerofoil portion, the radii of curvature of the fillets are equal to the thickness of the suction side outer wall, within ±25%, wherein the length of the surface of the inner wall forming a boundary between the inner wall and the suction wall passage, on the transverse cross-section is increased relative to the length of the surface of the suction side outer wall forming a boundary between the suction side outer wall and the suction wall passage, and the inner wall curves into the suction wall passages to give each suction wall passage a kidney-bowl shape on the transverse cross-sections.

* * * * *